US010662714B2

(12) United States Patent
Cunningham et al.

(10) Patent No.: US 10,662,714 B2
(45) Date of Patent: May 26, 2020

(54) DRILL BIT

(71) Applicant: Ulterra Drilling Technologies, L.P., Fort Worth, TX (US)

(72) Inventors: Jason Robert Cunningham, Thorsby (CA); Rachel Sarah Goodship, Calgary (CA); Blake Austin Byrnes, Fort Worth, TX (US); Carl Aron Deen, Fort Worth, TX (US)

(73) Assignee: Ulterra Drilling Technologies, L.P., Fort Worth, TX (US)

( * ) Notice: Subject to any disclaimer, the term of this patent is extended or adjusted under 35 U.S.C. 154(b) by 369 days.

(21) Appl. No.: 15/427,642

(22) Filed: Feb. 8, 2017

(65) Prior Publication Data

US 2017/0226811 A1 Aug. 10, 2017

Related U.S. Application Data

(60) Provisional application No. 62/292,551, filed on Feb. 8, 2016.

(51) Int. Cl.

| | |
|---|---|
| ***E21B 10/18*** | (2006.01) |
| ***E21B 19/18*** | (2006.01) |
| ***E21B 10/60*** | (2006.01) |
| ***E21B 7/06*** | (2006.01) |
| ***E21B 10/00*** | (2006.01) |
| ***E21B 10/08*** | (2006.01) |

(52) U.S. Cl.

CPC ..... *E21B 10/18* (2013.01); *E21B 7/064* (2013.01); *E21B 10/00* (2013.01); *E21B 10/08* (2013.01); *E21B 10/60* (2013.01); *E21B 10/602* (2013.01); *E21B 19/18* (2013.01)

(58) Field of Classification Search

CPC ..... E21B 10/00; E21B 10/08; E21B 10/18; E21B 10/60

See application file for complete search history.

(56) References Cited

U.S. PATENT DOCUMENTS

| | | | | | |
|---|---|---|---|---|---|
| 2,223,600 | A * | 12/1940 | Carleton | E21B 19/18 | 29/240 |
| 4,352,399 | A * | 10/1982 | Davis | E21B 19/18 | 173/164 |
| 4,495,840 | A * | 1/1985 | Freitag | E21B 19/18 | 175/315 |
| 5,794,728 | A * | 8/1998 | Palmberg | E21B 10/56 | 175/400 |
| 6,311,789 | B1 * | 11/2001 | Saxman | E21B 19/18 | 175/57 |
| 6,505,531 | B2 * | 1/2003 | Stogner | E21B 19/18 | 81/57.16 |

(Continued)

*Primary Examiner* — Tara E Schimpf

(74) *Attorney, Agent, or Firm* — Kilpatrick Townsend & Stockton LLP

(57) ABSTRACT

A rotary drill bit for directional drilling operations, in which a rotating bit with cutters advances a borehole in the earth invention, provides a smaller radius of curvature to increase drilling efficiency. The rotary drill bit comprises a box connection for connecting the bit to the drill string. The drill bit receives a pin connection that seats adjacent the plenum of the bit to shorten the distance between the bit face and steering tools behind the bit so the drill string can be steered more efficiently.

26 Claims, 6 Drawing Sheets

(56) References Cited

U.S. PATENT DOCUMENTS

| | | | | |
|---|---|---|---|---|
| 8,991,526 | B2 * | 3/2015 | Gillis | E21B 10/43<br>175/426 |
| 2012/0043087 | A1 * | 2/2012 | Torres | E21B 10/602<br>166/311 |
| 2012/0085583 | A1 * | 4/2012 | Logan | E21B 10/00<br>175/50 |
| 2013/0043874 | A1 * | 2/2013 | Clark | E21B 10/00<br>324/369 |
| 2014/0345426 | A1 * | 11/2014 | Rosano | E21B 19/164<br>81/57.18 |
| 2015/0107902 | A1 * | 4/2015 | Downton | E21B 7/062<br>175/45 |

* cited by examiner

DRILL BIT

RELATED APPLICATION

This application claims the benefit of U.S. provisional application No. 62/292,551, filed Feb. 8, 2016, entitled "Drill Bit," which is incorporated herein in its entirety by reference for all purposes.

TECHNICAL FIELD OF THE INVENTION

This invention is related to bits for advancing a borehole.

BACKGROUND OF THE INVENTION

In a typical drilling operation, a drill bit is rotated while being advanced into a formation within the earth. There are several types of drill bits, including roller cone bits, hammer bits and drag bits. There are many kinds of drag bits with various configurations of bit bodies, blades and cutters.

Drag bits typically include a body with a plurality of blades extending from the body with a face at a front end and a mounting pin at a rear end. The bit can be made of steel alloy, a tungsten matrix or other material. Drag bits typically have no moving parts with cutting elements brazed or otherwise attached to the blades of the body. Such bits are commonly manufactured by milling a billet or infiltrating brazing material into a powder matrix in a mold. Each blade supports one or more discrete cutters on the leading edge of the blades that contact, shear, grind and/or crush the rock formation in the borehole as the bit rotates to advance the borehole.

The drill string and the bit rotate about a longitudinal axis and the cutters mounted on the blades sweep a radial path in the borehole to fail rock. Cutters can be made from any durable material, but are conventionally formed from a tungsten carbide backing piece, or substrate, with a front facing table comprised of a diamond or other suitable material. The tungsten carbide substrates are formed of cemented tungsten carbide composed of tungsten carbide particles dispersed in a cobalt binder matrix.

FIG. 1 is a schematic representation of a drilling operation 2. In conventional drilling operations, a drill bit 10 is mounted on the lower end of a drill string 6 comprising drill pipe and drill collars. The drill string may be several miles long and the bit is rotated in the borehole 4 either by a motor proximate to the bit or by rotating the drill string, or both simultaneously. A pump 8 circulates drilling fluid through the drill pipe and out of the drill bit to flush rock cuttings from the bit and move them back up the annulus of the borehole. The drill string comprises sections of pipe that are threaded together at their ends to create a pipe of sufficient length to reach the bottom of the borehole 4.

Directional drilling advances the borehole in a transverse direction. Directional drilling typically uses "push-the-bit" or "point-the-bit" methods. Push-the-bit tools use pads on the drill string to press against the well bore so the bit presses on the opposite side advancing the borehole in the required transverse direction. Point-the-bit methods flex the drill string to redirect the drill bit.

SUMMARY OF THE INVENTION

The present invention generally pertains to drilling operations where a rotating bit with cutters advances a borehole in the earth. The bit is attached to the end of a drill string and is rotated to fail the rock in the borehole. Cutters on blades of the bit contact the formation and fail the rock of the borehole by shearing or crushing.

The present invention pertains to a bit that is advantageous in directional drilling. For instance, a borehole typically begins vertically and advances towards a desired strata. However, the target for the drill string can be offset from the initial borehole, requiring horizontal drilling to reach it. Directional drilling uses steering tools included in the drill string to redirect the drill bit to advance the borehole in a transverse direction. The rate of change of the direction of the borehole can be described as a radius of curvature and a shorter distance between the bit face and the steering tools can reduce the radius of curvature. One aspect of the invention pertains to a bit that provides a smaller radius of curvature to increase drilling efficiency.

In another aspect of the present invention, a bit is provided with a box (i.e., a female connection) for connecting the bit to the drill string. This construction allows the overall length of the drill bit to be shortened, reducing the distance between the bit face and steering tools behind the bit so the drill string can be steered more efficiently. The female connection allows it to overlap the gauge pad section of the bit as compared to the standard pin connection, which cannot overlap with the gauge portion and must be positioned between the gauge pad section of the bit and the drill string.

In one other aspect of the present invention, a bit receives a pin connection, which is on the end of the drill string to which the bit is connected. The pin connection seats adjacent a plenum of the bit to allow the pin connection to be closer to the cutting face of the drill bit.

In another aspect of the invention, a bit includes internal threads for an API connection where the threads extend into a gage portion of the bit. In one embodiment, the API connection overlaps at least 40% into the gage portion.

In another aspect of the invention, a bit includes a box API connection where the length of the threaded connection is at least 40% of the length of the bit. In one embodiment, the length of the API connection is at least 50% of the length of the bit.

In another aspect of the invention, a bit includes a box API connection where the length of the bit forward of the threads is less than the diameter of the bit.

In another aspect of the invention, the length of the bit is less than one and half times the diameter of the bit. In one embodiment, the length of the bit is less than 1.3 times the diameter of the bit.

In another aspect of the invention, the length of the drill bit includes a plurality of blades, a gage portion, and an API connection, and has a length that is less than 8½ inches. In another aspect of the invention, the distance from the rear of the plenum to the rear of the bit is less than 4½ inches. In another aspect of the invention, the length of the plenum forward of the API connection is less than three inches. In one embodiment, the length of the plenum forward of the API connection is less than 2¼ inches.

In another aspect of the invention, the length of the bit is less than 2½ times the length of threads on the API connection. In one embodiment, the length of the bit is less than two times the length of the threads on the API connection.

In another aspect of the invention, the length of the bit is more than three times the length of the plenum forward of the API connection. In one embodiment, the length of the bit is more than three and half times the length of the plenum forward of the API connection.

In another aspect of the invention, a drill string includes steering tools behind a bit with a pad to contact the borehole and the distance between the bit face and the pad is less than two diameters of the bits. In another aspect of the invention, a breaker sleeve or plate fits over the bit face and engages the sides of the blades to grip the bit and separate it from the drill string. In one embodiment, the removal tool is in the form of a plate that includes an opening generally corresponding to the blades and body of the bit. That is, the removal tool accepts the bit in an opening with bearing surfaces received into the channels between the blades to engage the blades on a side generally without the cutters. The bearing surfaces on the removal tool can apply pressure to the blades to separate the bit from the drill string. The removal tool limits rotation of the bit without bearing on cutters or other components that can sustain damage, and supports the bit once it is separated from the drill string.

The various above-noted aspects and embodiments can be used together or independently of each other. Other aspects, advantages, and features of the invention will be described in more detail below and will be recognizable from the following detailed description of example structures in accordance with this disclosure.

DETAILED DESCRIPTION OF THE INVENTION

Bits used in downhole boring operations such as for gas and oil exploration operate at extreme conditions of heat and pressure often miles underground. Drag bits most often include PDC cutters mounted on blades of the bit that engage the surfaces of the borehole to fail the rock in the borehole. Each cutter is retained in a recess of the blade and secured by brazing, welding or other method. Drilling fluid is pumped down the drill string through the plenum, ducts and nozzles in the bit body to flush the rock cuttings away from the bit and up the borehole annulus.

Steering tools included in the drill string behind the bit allow the drill bit to advance the borehole along a curve to bore horizontally or to steer the borehole to follow strata or around ground structures. A short bit allows the drill string to make shorter sharper turns.

Figure 1:
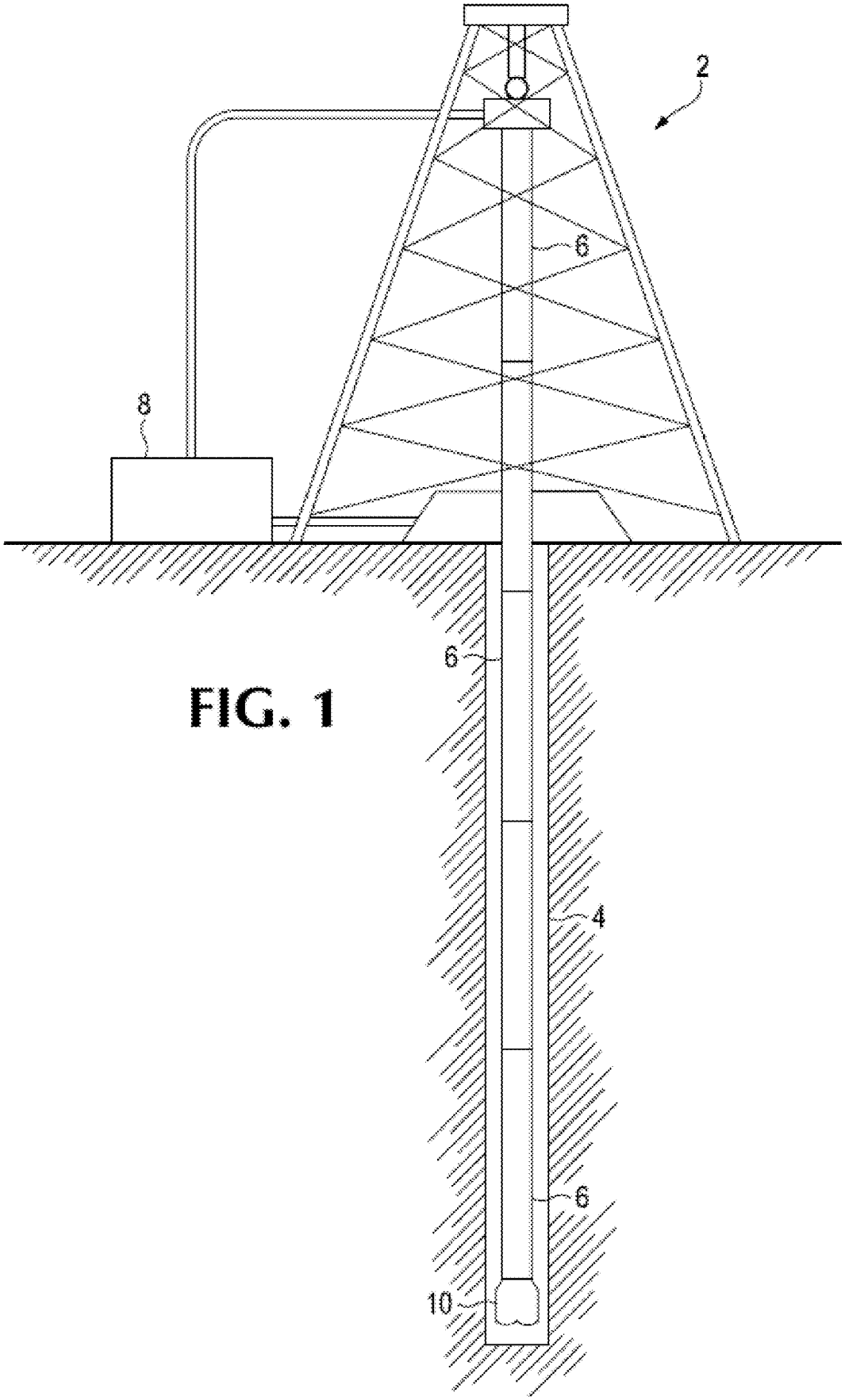
FIG. 1 is a schematic depiction of a drilling system.
Figure 2:
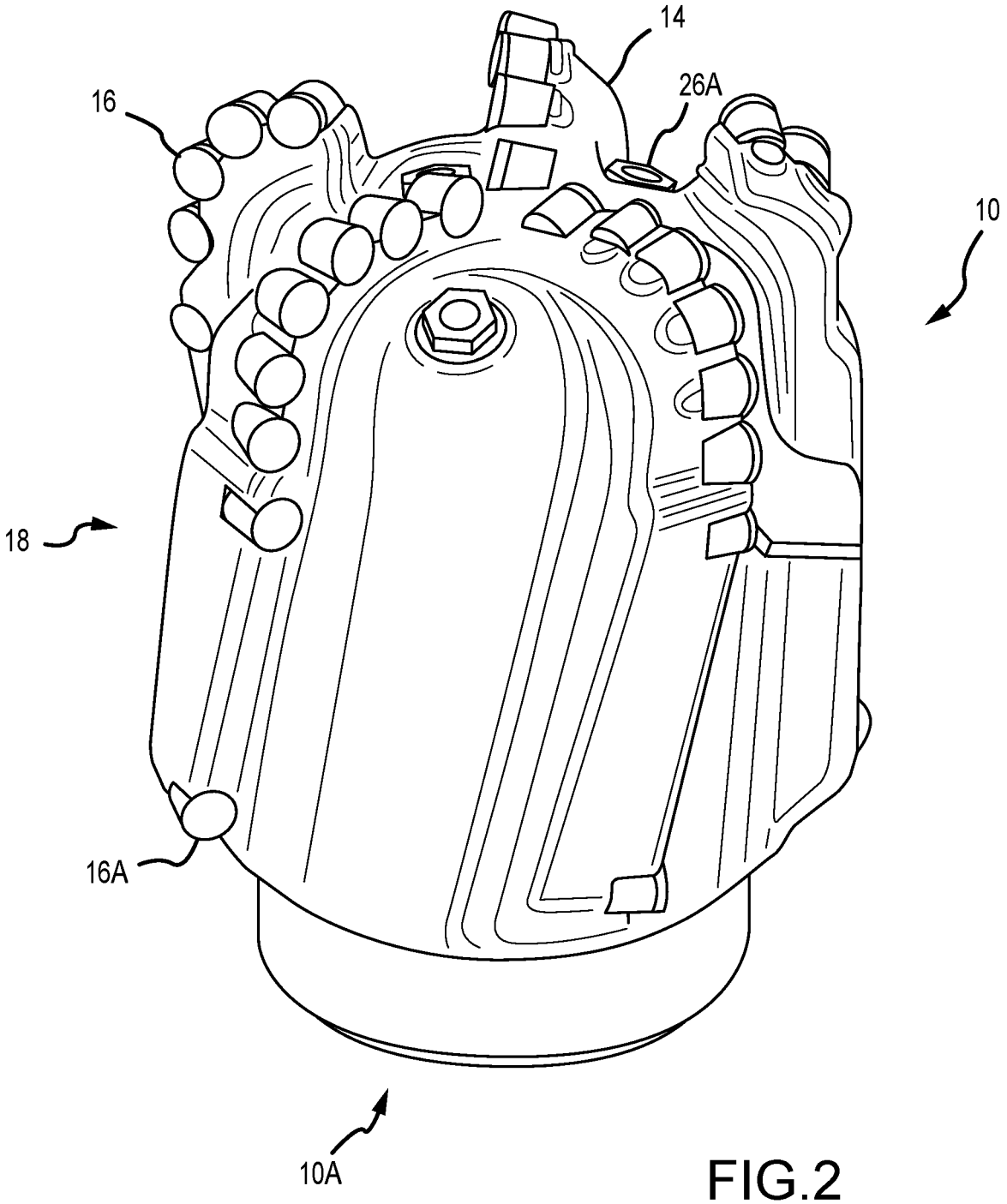
FIG. 2 is a perspective view of a bit.
Figure 3:
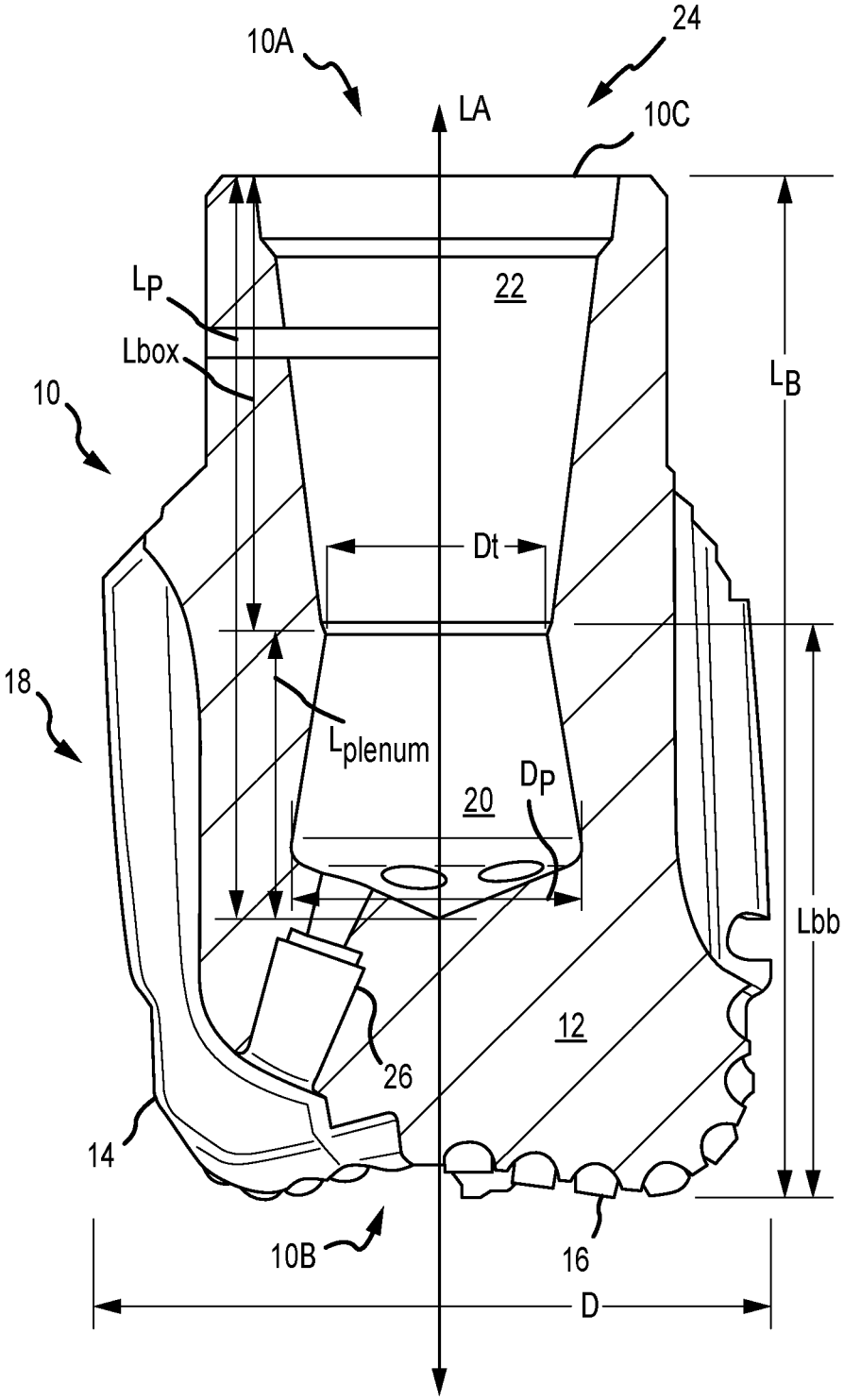
FIG. 3 is a vertical, center cross section view of the bit of FIG. 2.

A bit is shown generally in FIGS. 2 and 3. The bit 10 includes a bit body 12 and blades 14 extending from the body. The blades support cutters 16. The bit includes a rearward mounting portion 10A to connect to the drill string and a forward portion or face 10B for advancing the borehole. A box connector 22 at the rear end of the bit adjacent and continuous with plenum 20 forms an opening 24 extending forward toward the bit face along a longitudinal axis LA. Bit 10 rotates about the longitudinal or rotational axis LA. Connectors generally conform to American Petroleum Institute (API) standards.

The female API or box connector 22 includes threads for connecting the bit to the drill string. The threads can be machined into the bit body. Alternatively, the box can be manufactured separately and attached to the body 12. The box can be welded or otherwise attached to the bit body. Sleeves can also be welded to the bit body extending rearward.

A gage portion 18 of the bit rearward of the bit face defines the diameter of the bit. The gage portion of the bit maintains a cutting or gage profile that corresponds generally to the borehole diameter along its length. The gage portion can include blades supporting cutters 16A. The cutting profile as the bit rotates is generally cylindrical at the gage portion although the cutting or gage profile can include some interruptions. The box 22 can extend into the gage section so the pin of the drill string received in the box extends into and overlaps with the gage section. In some embodiments the plenum and/or the threads of the box can extend forward of the gage section of the bit. In one embodiment, the box connector 22 extends into the bit and overlaps with at least forty percent of the gage portion.

The face of the plenum includes openings to ducts that extend through the bit body to the face of the bit. The ducts generally open to the plenum and to channels of the bit face. Ducts are generally configured to receive nozzles 26A that direct and shape the output of the fluid, and liners to protect the duct surface from erosion by materials suspended in the fluid. Liners, nozzles and/or other duct components 26A can be retained in the bit with threads, tapers or decreasing diameters of the ducts extending away from the plenum. The fluid under pressure flows into the plenum and through ducts. The fluid flushes failed material from the bit face through the channels.

The box section 22 extends from a top edge of the bit 10C. The plenum portion extends from the end of the box threads forward to the forward-most portion of the front plenum face to define a plenum length Lplenum. The plenum and box forming the opening defines a cavity length Lp. The bit has a diameter D at the gage portion of the bit and generally corresponds to the diameter of the hole advanced by the bit. The plenum portion is shown with a throat portion at the top with a diameter Dt and diverges extending forward to a diameter Dp and is generally round in cross section. Other configurations for the plenum than this example are possible. The female API connection extending into the bit and adjacent the short plenum provides a shorter overall length of the bit from the front face to the rear connection face.

The bit has an overall length Lb and a bit body length Lbb measured from the end of the threads to the bit face. The length of the box or length from the back of the bit to the end of the threads is Lbox. The overall bit length Lb can be less than 9 inches, and in one embodiment is less than 8½ inches. Alternatively, the overall bit length Lb can be less than 10 inches. The ratio of the length of the box Lbox to the length of the bit Lb is greater than 0.4. Alternatively, the ratio of Lbox to Lb is greater than 0.5.

The ratio of the bit body length Lbb to the bit diameter D can be less than 1.0. Alternatively, the ratio of Lbb to D can be less than 0.9. Alternatively, the ratio of Lbb to D can be less than 0.8.

The ratio of the bit diameter D to the length of the bit Lb can be greater than 0.65. Alternatively, the ratio of the bit diameter D to the length of the bit Lb can be greater than 0.7.

The ratio of the length of the box Lbox to the length of the bit Lb can be greater than 0.4.

The ratio of the bit body forward of the threads Lbb to the length of the bit Lb can be greater than 0.4. Alternatively, the ratio of Lbb to Lb can be greater than 0.45.

The ratio of the length of the box Lbox to the length of the bit Lb can be greater than 0.4. Alternatively, the ratio of Lbox to Lb can be greater than 0.45, and in one embodiment is greater than 0.5. In another embodiment, the length of the bit is less than 2½ times the length of threads on the API connection, and in another embodiment, the bit is less than two times the length of the threads on the API connection. In another embodiment, a bit includes a box API connection where the length of the bit forward of the threads Lbb is less than the diameter of the bit.

In one embodiment, the length of the bit is less than one and half times the diameter of the bit. In another embodiment, the length of the bit is less than 1.3 times the diameter of the bit. In another embodiment, the diameter is more than 75% the length of the bit.

In one embodiment, the length of the drill bit includes a plurality of blades, a gage portion, and an API connection, and is less than 8½ inches. In another embodiment, the distance from the rear of the plenum to the rear of the bit is less than 4½ inches. In another embodiment, the length of the plenum forward of the API connection is less than three inches. In one other embodiment, the length of the plenum forward of the API connection is less than 2¼ inches.

In another embodiment, the length of the bit is more than three times the length of the plenum forward of the API connection. In one other embodiment, the length of the bit is more than three and half times the length of the plenum forward of the API connection.

In one embodiment advantageous to directional drilling, the bit includes blades with cutters for failing the rock, a box or female connector, and a plenum for directing the fluid out to the bit face. The overall length Lb of the bit is less than 8½ inches long, less than 30% larger than the diameter D of the bit (i.e., Lb/D<1.3), and less than two times the length of the API connector. The plenum forward of the API threads is less than 2¼ inches, and about ¼ of the overall length Lb of the bit.

While a drag bit is described in these examples, this is for the purpose of illustration. These features can be used in other kinds of downhole tools such as core bits and impreg bits. Previous bits have been formed from a bit body portion and a threaded connector portion that are formed separately and bonded together. A separate bit body allows the plenum to be formed without reaching through the connector portion. The present invention allows a bit to be machined as a single unit, though it need not be.

A steel bit is typically machined from a billet. The billet is a cylindrical steel section at least as large as the desired bit. Alternatively, the bit can be formed by casting a preliminary bit shape in a mold. Preferably, the preliminary shape is a near net shape that closely resembles the final shape of the bit, i.e., preferably as close as practicable allowing for the casting tolerances. This construction reduces the amount of machining required, which in turn reduces time of manufacture, costs, and machining materials. The casting process is carried out by known means. While sand casting is preferred, other known casting procedures such as investment casting can also be used. Alternatively, the bit can be manufactured by infiltrating a brazing material into hard wear particles in a mold.

Figure 4:
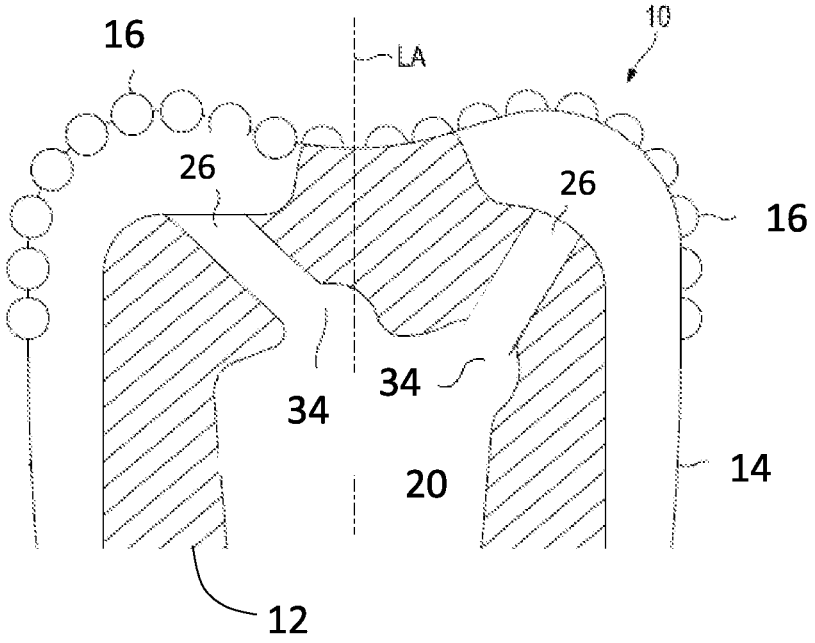
FIG. 4 is a cross section view of a portion of a bit body with a plenum.

The plenum can be configured to optimize flow to the ducts as shown in FIG. 4. At the upstream opening of duct 26, the plenum as cast has an extension 34 or transition section extending into the bit body 12. The plenum extensions preferably limit sharp transitions that can initiate turbulence in the fluid entering the ducts 26 and increase erosion of the plenum surface.

Figure 7:
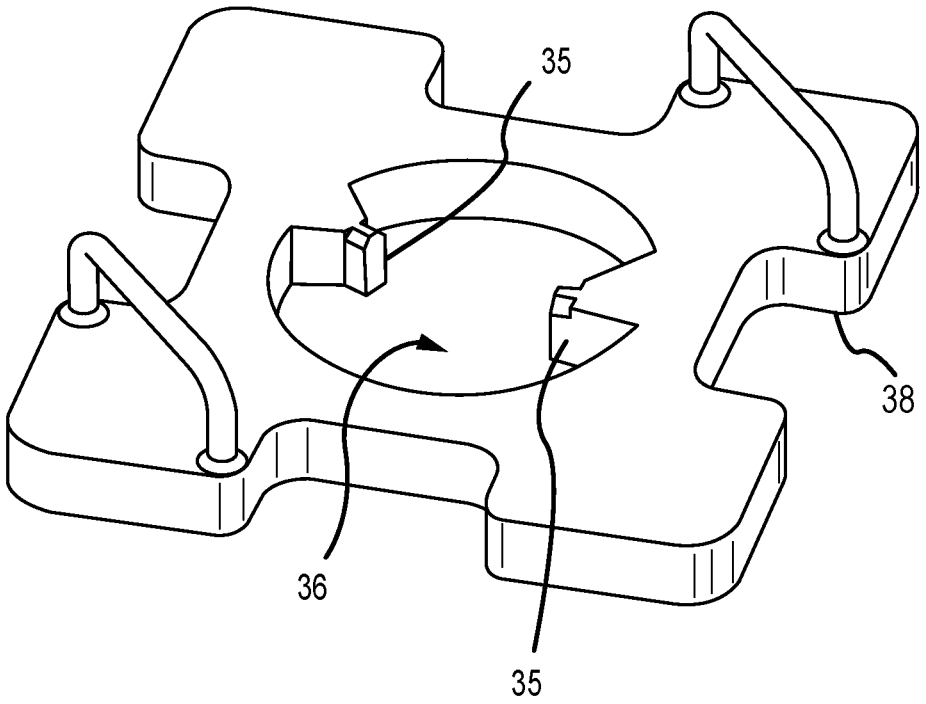
FIG. 7 is a perspective view showing a removal tool to separate the bit from the drill string.

In previous bits, the pin connection generally include flats on the outside surface that provided a grip or bearing surface for a tool to separate the pin and bit from the drill string. In other embodiments, flats are included between the blades proximate the bit face. In one embodiment of the present invention, the length of the bit can be minimized to achieve the desired short configuration by using a configuration of flats between the blades proximate the bit face to separate the bit from the drill string. A breaker tool or plate 38 as shown in FIG. 7 receives the bit face and engages the sides of the blades without cutters to grip the bit and separate it from the drill string. The removal tool can be in the form of a breaker plate that is secured on a floor of the drill rig or otherwise below the bit, though other constructions are possible. The plate includes an opening 36 corresponding to the blades and body of the bit. The plate accepts the bit in the opening and includes bearing surfaces 35 extending inwardly from the periphery of the opening, which are sized and positioned to be received in the bit slots or channels between the blades on the side of the bit. The bearing surfaces engage the sides of the blades without the cutters. The plate limits rotation of the bit without bearing on cutters or other components that can sustain damage and supports the bit once it is separated from the drill string. Alternatively, or additionally, the opening in the plate can be sized and shape to allow the bearing surfaces to move into openings between gauge pads disposed around the outer circumference of the gauge portion of the drill bit and engage the sides of gauge pads.

Figures 5, 6:
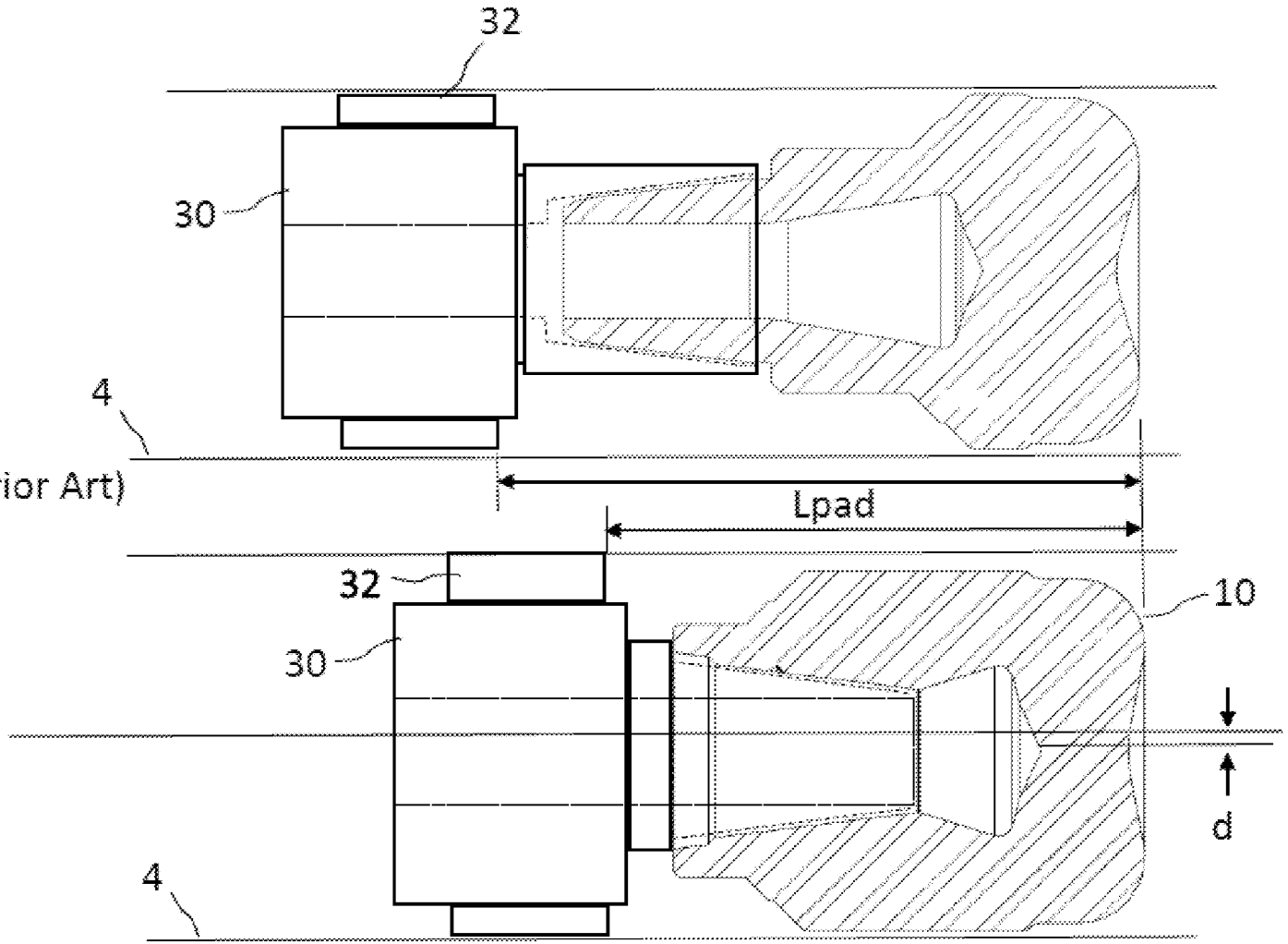
Fig. 6 (Prior Art)
FIG. 5 is a cross section view of a drill string with a tool for directional drilling.
FIG. 6 is a cross section view of a prior art drill string with a tool for directional drilling.

In one embodiment, the drill string 6 can incorporate additional tools such as a steering tool 30 as shown in FIG. 5. The steering tool can include pads 32 that extend from the tool to contact the borehole 4. The pad bearing on the borehole causes the bit 10 to bear on the borehole on the opposite side from the pad. The axis of the drill string deflects a distance d from the borehole centerline and initiates a lateral deflection of the borehole as the bit advances. The section of the drill string between the pad bearing on the borehole and the face of the bit has a length Lpad which can flex limiting the deflection d of the bit. Minimizing the length of this portion of the drill string increases the deflection of the bit d and minimizes the radius of curvature of the directional drilling. The smaller radius of turn for the drill string maximizes operational efficiency. FIG. 6 shows a prior art bit with a pin connection and a steering tool 30 with pads 32. The distance Lpad is longer in the prior art configuration than the configuration of FIG. 5.

It should be appreciated that although selected methods of producing a bit, and embodiments of representative bits, are disclosed herein, numerous variations of these embodiments and methods may be envisioned by one of ordinary skill that do not deviate from the scope of the present disclosure. This presently disclosed invention lends itself to use for steel bits as well as a variety of styles of bits.

It is believed that the disclosure set forth herein encompasses multiple distinct inventions with independent utility. While each of these inventions has been disclosed in one exemplary form, the specific embodiments thereof as disclosed and illustrated herein are not to be considered in a limiting sense as numerous variations are possible. Each example defines an embodiment disclosed in the foregoing disclosure, but any one example does not necessarily encompass all features or combinations that may be eventually claimed. Where the description recites “a” or “a first”

element or the equivalent thereof, such description includes one or more such elements, neither requiring nor excluding two or more such elements.

What is claimed is:

1. An apparatus for drilling a wellbore through an earth formation for production of hydrocarbons, the apparatus comprising a rotary drill bit, the drill bit comprising:

a bit body for rotation about a longitudinal axis, the bit body comprising a forward portion with a face, a gage portion defining an outer diameter of the bit and configured to maintain a gage profile that corresponds to a diameter of the wellbore, and a rearward mounting portion, the rearward mounting portion comprising a box connection with an opening for receiving a connection on a drill string; and a continuous cavity defined in the bit body extending into the center of the drill bit body, along its longitudinal axis, and having at one end a plenum connected with at least one duct for delivering drilling fluid to the face, and at the other end the opening;

wherein the box connection comprises internal threads formed along an inside surface of the cavity that extend partway into the gage portion; and wherein the box connection tapers to a diameter that is less than a diameter of the plenum.

2. The apparatus of claim 1, wherein the box connection is adapted for receiving a pin connection on the end of the drill string that seats adjacent the plenum.

3. The apparatus of claim 1, wherein the internal threads are formed within the portion of the cavity within the rearward mounting portion of the drill bit.

4. The apparatus of claim 1, wherein the internal threads extend into the gage portion at least a distance of at least equal to 40% into a length of the gage portion.

5. The apparatus of claim 1, wherein the box connection comprises an American Petroleum Institute (API) connection, and wherein a length of the API connection is at least 40% of a length of the drill bit as measured along its longitudinal axis.

6. The rotary drill of claim 5, wherein the length of the API connection is at least 50% of the length of the drill bit.

7. The rotary drill of claim 1, wherein the box connection comprises an API connection with threads, wherein the length of the bit forward of the threads is less than a diameter of the drill bit.

8. The apparatus of claim 1, wherein a length of the drill bit, as measured along its longitudinal axis, is less than one and half times a diameter of the bit.

9. The apparatus of claim 8, wherein the length of the drill bit is less than 1.3 times the diameter of the drill bit.

10. The apparatus of claim 1, wherein the rotary drill bit further comprises a plurality of blades along its face, to which a plurality of cutters are mounted, wherein the box connection is an API connection and the drill bit has a length as measured along its longitudinal axis of less than 8½ inches.

11. The apparatus of claim 1, wherein a distance from a rear of the plenum to a rear of the rotary drill bit is less than 4½ inches.

12. The apparatus of claim 1, wherein the box connection is an API connection, and a length of the plenum forward of the API connection is less than three inches.

13. The apparatus of claim 12, wherein the length of the plenum forward of the API connection is less than 2¼ inches.

14. The apparatus of claim 13, the length of the drill bit is less than two times the length of the threads on the API connection.

15. The apparatus of claim 1, wherein the box connection is an API connection, and a length of the drill bit, as measured along its longitudinal axis, is less than 2½ times a length of threads on the API connection.

16. The apparatus of claim 1, wherein the box connection is an API connection, and a length of the drill bit, as measured along its longitudinal axis, is more than three times a length of the plenum forward of the API connection.

17. The apparatus of claim 16, wherein the length of the bit is more than three and half times the length of the plenum forward of the API connection.

18. The apparatus of claim 1, further comprising the drill string, to which the drill bit is connected; wherein the drill string comprises steering tools behind the drill bit with at least one pad to contact the borehole; and wherein a distance between the bit face and the pad is less than twice a diameter of the drill bit.

19. An apparatus for separating a drill bit from a drill string, the drill bit having a face, from which extends a plurality of blades with cutting elements, the apparatus comprising an engaging structure having an opening for fitting over the bit face, wherein the engaging structure includes at least one protrusion extending inwardly from a periphery of the opening, wherein the at least one protrusion includes a tapered base and a bearing member, wherein the tapered base is tapered from the periphery of the opening toward the bearing member, wherein the bearing member includes opposing bearing surfaces, and wherein one of the opposing bearing surfaces is configured to engage a side of a blade to grip the bit and rotate it to separate it from the drill string.

20. The apparatus of claim 19, wherein at least the bearing member is configured for insertion into channels between the blades on the drill bit for the one of the opposing bearing surfaces to engage the blade on the side opposite a leading edge of the blade on which cutters are mounted, whereby the bearing member is capable of applying pressure to the blade to separate the bit from the drill string.

21. The apparatus of claim 19, wherein the engaging structure comprises a sleeve.

22. The apparatus of claim 19, wherein the engaging structure comprises a plate.

23. An apparatus for facilitating rotation of a drill bit relative to a drill string, the drill bit having a plurality of blades with cutters mounted thereon, the apparatus comprising an engaging structure, wherein the engaging structure includes an opening for fitting over the drill bit and at least one protrusion extending radially inward from a periphery of the opening, wherein the at least one protrusion comprises a base and a bearing member, and wherein the bearing member includes opposing bearing surfaces each configured to engage a side of a blade to grip the bit and facilitate rotation of the drill bit relative to the drill string.

24. The apparatus of claim 23, wherein the drill bit includes a gage portion defining an outer diameter of the drill bit, wherein the plurality of blades extends into the gage portion, wherein the opening of the engaging structure is configured to fit over the gage portion, and wherein at least one of the opposing bearing surfaces of the bearing member is configured to engage a side of the blade in the gage portion.

25. The apparatus of claim 23, wherein the base is tapered from the periphery of the opening toward the bearing member.

26. The apparatus of claim 23, wherein the bearing member is configured to be received in a channel at the side of the blade for at least one of the opposing bearing surfaces to engage the side of the blade.

* * * * *